US009126656B2

(12) United States Patent
Griffith

(10) Patent No.: US 9,126,656 B2
(45) Date of Patent: Sep. 8, 2015

(54) FLUSH GLAZED WINDSHIELD MOUNTING

(71) Applicant: Taylor Made Group, LLC, Gloversville, NY (US)

(72) Inventor: Douglas D. Griffith, Speculator, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 14/187,873

(22) Filed: Feb. 24, 2014

(65) Prior Publication Data

US 2014/0165497 A1 Jun. 19, 2014

Related U.S. Application Data

(60) Continuation of application No. 13/430,832, filed on Mar. 27, 2012, now Pat. No. 8,656,594, which is a division of application No. 12/208,622, filed on Sep. 11, 2008, now Pat. No. 8,166,725.

(51) Int. Cl.
*B63B 17/00* (2006.01)

(52) U.S. Cl.
CPC ..... *B63B 17/00* (2013.01); *B63B 2221/22* (2013.10); *Y10T 29/49622* (2015.01); *Y10T 29/49623* (2015.01); *Y10T 29/49826* (2015.01); *Y10T 29/49904* (2015.01); *Y10T 29/49963* (2015.01)

(58) Field of Classification Search
CPC ..... B63B 2221/20; B63B 2221/22; B63B 2221/24; B63B 17/00; B63B 2017/0045; B63B 19/02; B63B 2704/00
USPC ..... 29/897.2, 897.36, 469, 522.1, 525.11; 52/716.6, 165, 716.2; 114/361; 119/789, 791; 248/508, 509
See application file for complete search history.

(56) References Cited

U.S. PATENT DOCUMENTS

| | | | | | |
|---|---|---|---|---|---|
| 1,858,880 | A | * | 5/1932 | Carlson | 296/92 |
| 1,860,198 | A | * | 5/1932 | Moore et al. | 296/92 |
| 3,016,548 | A | * | 1/1962 | Taylor | 114/361 |
| 3,093,844 | A | | 6/1963 | Brock et al. | |
| 3,123,839 | A | | 3/1964 | Reid | |
| 3,304,657 | A | * | 2/1967 | Singleton | 49/399 |
| 3,416,833 | A | | 12/1968 | Griffin | |
| 3,654,648 | A | | 4/1972 | Wilhoit | |
| 3,810,267 | A | * | 5/1974 | Fussell et al. | 114/361 |
| 3,967,424 | A | | 7/1976 | Gates | |
| 3,978,535 | A | | 9/1976 | Swan et al. | |
| 4,151,620 | A | | 5/1979 | Heuzonter | |

(Continued)

FOREIGN PATENT DOCUMENTS

FR 2 684 051 5/1993

*Primary Examiner* — Jason L Vaughan
(74) *Attorney, Agent, or Firm* — Nixon & Vanderhye P.C.

(57) ABSTRACT

A bottom trim member secures a curved sheet element such as a windshield or the like on a surface. The bottom trim member includes a bottom trim extrusion having a connecting leg affixable to the curved sheet element and a gasket receiving leg. A gasket is disposed in engagement with the gasket receiving leg, where the gasket is shaped such that the bottom trim extrusion is positionable in multiple orientations relative to the surface and such that the gasket maintains a sealing engagement in any of the bottom trim extrusion multiple orientations. A securing member is affixable to the surface and cooperable with the bottom trim extrusion to secure the bottom trim extrusion to the surface in any one of the bottom trim extrusion multiple orientations.

19 Claims, 5 Drawing Sheets

(56) References Cited

U.S. PATENT DOCUMENTS

| | | | | | |
|---|---|---|---|---|---|
| 4,750,449 | A | * | 6/1988 | Muhlberger | 114/361 |
| 4,815,410 | A | | 3/1989 | Muhlberger | |
| 4,874,201 | A | | 10/1989 | Scaglietti | |
| 5,054,242 | A | | 10/1991 | Keys et al. | |
| 5,154,028 | A | | 10/1992 | Hill et al. | |
| 5,269,250 | A | | 12/1993 | Daniels | |
| 5,586,798 | A | | 12/1996 | Saegusa | |
| 5,601,050 | A | * | 2/1997 | Erskine et al. | 114/361 |
| 5,711,119 | A | | 1/1998 | Cornils et al. | |
| 5,804,018 | A | | 9/1998 | Fisher et al. | |
| 5,815,997 | A | | 10/1998 | Cornils et al. | |
| 6,022,063 | A | | 2/2000 | Frost et al. | |
| 6,022,065 | A | | 2/2000 | Stopp et al. | |
| 6,158,372 | A | | 12/2000 | Erskine | |
| 6,241,304 | B1 | | 6/2001 | Frost | |
| 7,281,486 | B2 | | 10/2007 | Bach et al. | |
| 7,415,938 | B2 | | 8/2008 | Duffield | |
| 7,418,917 | B2 | | 9/2008 | Bach | |
| 7,434,533 | B2 | * | 10/2008 | Erskine et al. | 114/361 |
| 7,506,605 | B2 | | 3/2009 | Duffield | |
| 7,591,231 | B2 | | 9/2009 | Shearer et al. | |
| 7,845,304 | B2 | * | 12/2010 | Daniels et al. | 114/361 |
| 8,166,725 | B2 | | 5/2012 | Griffith | |
| 8,656,594 | B2 | * | 2/2014 | Griffith | 29/897.2 |
| 2007/0215031 | A1 | | 9/2007 | Bach et al. | |
| 2008/0098948 | A1 | | 5/2008 | Shearer et al. | |

* cited by examiner

FLUSH GLAZED WINDSHIELD MOUNTING

CROSS-REFERENCES TO RELATED APPLICATIONS

This application is a continuation of U.S. patent application Ser. No. 13/430,832, filed Mar. 27, 2012, pending, which is a divisional of U.S. patent application Ser. No. 12/208,622, filed Sep. 11, 2008, now U.S. Pat. No. 8,166,725, the entire contents of each of which is hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to apparatus and methods for mounting a curved sheet element on a surface and, more particularly, relates to apparatus and methods for mounting a windshield on the deck of a boat. Use of the term "curved sheet" is intended to encompass a generally flat sheet with some curvature to the sheet wings and fronts.

Systems for mounting curved sheet elements to a surface, particularly mounting curved windshields to the deck of a boat, are known. One such mounting system includes an elongated member having upper, intermediate and lower portions wherein the upper portion comprises, in cross-section, a generally channel-shaped receptacle for receiving the lower edge of the curved windshield. The lower portion includes a flat which extends from the intermediate portion at an angle of approximately 45° relative to the base of the channel-shaped upper portion. The intermediate portion includes angularly related portions connected along one edge intermediate of and to the base of the channel while the other angularly related portion extends rearwardly for connection with the flat. The forward portion of the flat terminates in a free edge defining a receptacle for receiving the trim piece with the base of the channel, the intermediate portion and the inside surface of the flat.

In using such a mounting system, it is necessary to bend the elongated member to conform it to the curvature of the lower edge of the glass. In bending the member, however, twisting also occurs, causing the flat to stand up from the deck. That is, the flat will not maintain a flush continuous contact with the deck over the full length of the member. Additionally, the mounting member is secured to the deck by screws disposed through the flat. The compound curvature of the mounting member, however, makes it difficult to mount the screws and secure the mounting member and windshield to the deck. Even after such securement, gaps appear between the mounting member and the deck.

Some of the more modern boats are using a flush glazed window that hides the bottom trim so that it is not seen from the outside of the boat. Design approaches to achieve this flush glazed look have used either a combination of two bottom trims, one that is mounted to the boat deck and the other that is mounted to the inside of the windshield, or trims that have fixed angles. The first approach is often bulky and requires twice the number of extrusions as a standard mounting system. The second approach is limited in the angle between the windshield and the boat deck such that it is unusable on the boat deck if the angle changes much along the length of the windshield, as most boat windshields do.

BRIEF SUMMARY OF THE INVENTION

According to the preferred embodiments, a bottom trim member is designed to overcome the drawbacks of the prior constructions. The trim member is compact and incorporates a bottom gasket that is usable in multiple ways. One of the ways uses only one extrusion with a mounting clip. Another is screwed directly to the deck. The third approach uses another compact extrusion along the length of the windshield.

In an exemplary embodiment, a bottom trim member secures a curved sheet element such as a windshield or the like on a surface. The bottom trim member includes a bottom trim extrusion having a connecting leg affixable to the curved sheet element and a gasket receiving leg. A gasket is disposed in engagement with the gasket receiving leg, where the gasket is shaped such that the bottom trim extrusion is positionable in multiple orientations relative to the surface and such that the gasket maintains a sealing engagement in any of the bottom trim extrusion multiple orientations. A securing member is affixable to the surface and cooperable with the bottom trim extrusion to secure the bottom trim extrusion to the surface in any one of the bottom trim extrusion multiple orientations. Preferably, the gasket is cylindrical.

In one arrangement, the securing member is a mounting clip affixable to the surface with a connector, such as a screw or the like. The mounting clip includes a connecting arm engageable with the gasket receiving leg in a channel defined between the gasket receiving leg and the connecting leg of the bottom trim extrusion. With a cylindrical gasket, the gasket receiving leg may be shaped corresponding to an external surface of the gasket, where the connecting arm has a curved inside surface engageable with an outside surface of the gasket receiving leg.

In another arrangement, the securing member is a connector extendable through the gasket receiving leg and the gasket into the surface. In this context, a cover may be disposed over an outside surface of the gasket receiving leg to conceal the connector.

In still another arrangement, the securing member includes a lower extrusion including a base leg securable directly to the surface via a connector and a support leg engageable with the gasket receiving leg in a channel defined between the gasket receiving leg and the connecting leg of the bottom trim extrusion. The base leg and the support leg preferably define a receiving area therebetween, where the gasket receiving leg and the gasket are secured in the receiving area.

In another exemplary embodiment, a bottom trim member secures a windshield to a boat surface. The bottom trim member includes a bottom trim extrusion including a connecting leg affixable to the windshield and a gasket receiving leg; a cylindrical gasket disposed in engagement with the gasket receiving leg, the cylindrical gasket being formed of an elastic material; and a securing member affixable to the boat surface and cooperable with the bottom trim extrusion and the gasket to secure the bottom trim extrusion to the boat surface. The gasket is disposed in a compressed state to hold the bottom trim extrusion and the securing member in engagement with each other. With the mounting clip arrangement, the gasket is compressed between the boat surface and the connecting arm. With the connector arrangement, the gasket is compressed between the boat surface and a head of the connector. Finally, with the lower extrusion arrangement, the gasket is compressed between the base leg and the support leg. The base leg and the support leg may define a receiving area therebetween, where the gasket receiving leg and the gasket are secured in the receiving area.

In yet another exemplary embodiment, a method of securing a curved sheet element on a surface includes the steps of affixing a connecting leg of a bottom trim extrusion to the curved sheet element; positioning a cylindrical gasket in engagement with a gasket receiving leg of the bottom trim extrusion, the cylindrical gasket being formed of an elastic material; affixing a securing member to the surface; and compressing the cylindrical gasket and the gasket receiving leg into a space defined by the securing member.

BRIEF DESCRIPTION OF THE DRAWINGS

These and other aspects and advantages will be described in detail with reference to the accompanying drawings, in which.

DETAILED DESCRIPTION OF THE INVENTION

Figure 2:
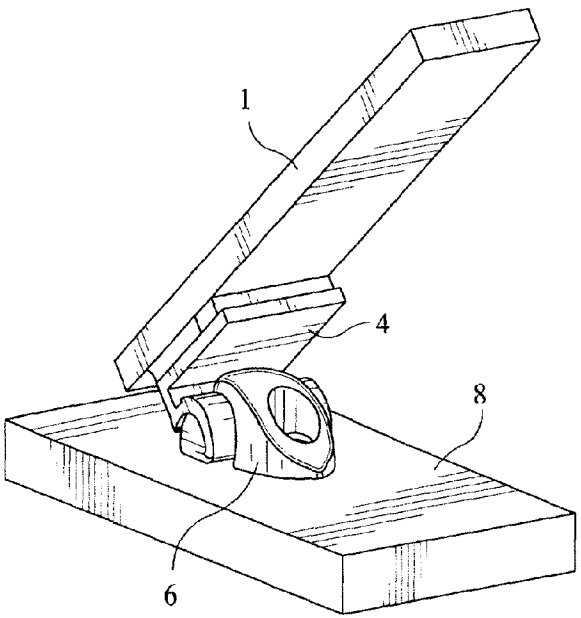
FIGS. 2 and 4 are rear perspective views of the bottom trim member in FIGS. 1 and 3.

FIGS. 1-4 illustrate a first embodiment of the bottom trim member. As shown, the trim member serves to secure a curved sheet element 1, such as a boat windshield or the like, on a surface 8, such as a boat deck or the like. Each of the embodiments described herein includes a bottom trim extrusion 4 glued to an inside surface of the curved sheet element 1. Preferably, the bottom trim extrusion 4 is secured to the curved sheet element 1 using a combination of glazing foam 2 and an adhesive 3.

The bottom trim extrusion 4 includes a connecting leg 4*a* that is affixable to the curved sheet element 1 and a gasket receiving leg 4*b* that receives a preferably cylindrical shaped gasket 5. The gasket 5 is also common to each of the described embodiments, and is preferably formed of an elastic material such as rubber or the like. As shown, the gasket receiving leg 4*b* is shaped corresponding to an external surface of the gasket 5. The connecting leg 4*a* and the gasket receiving leg 4*b* are disposed relative to each other generally to define a channel 4*c*.

Figure 1:
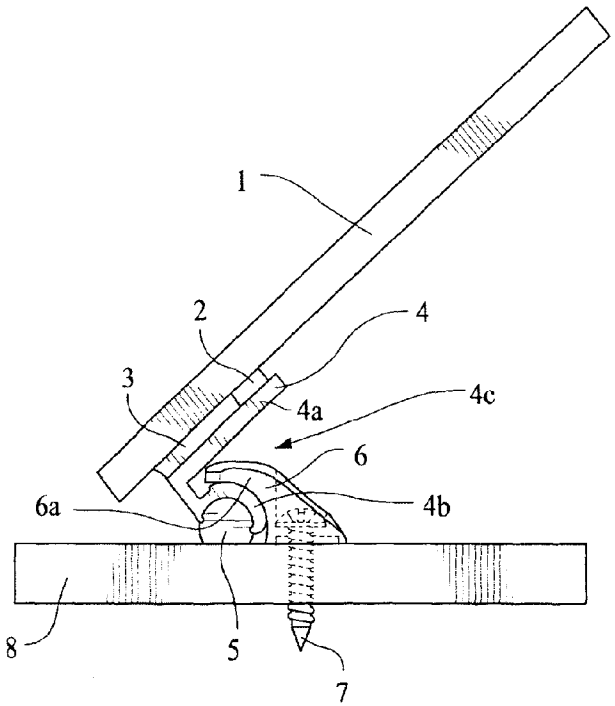
FIGS. 1 and 3 are end views of a first bottom trim member.
Figure 4:
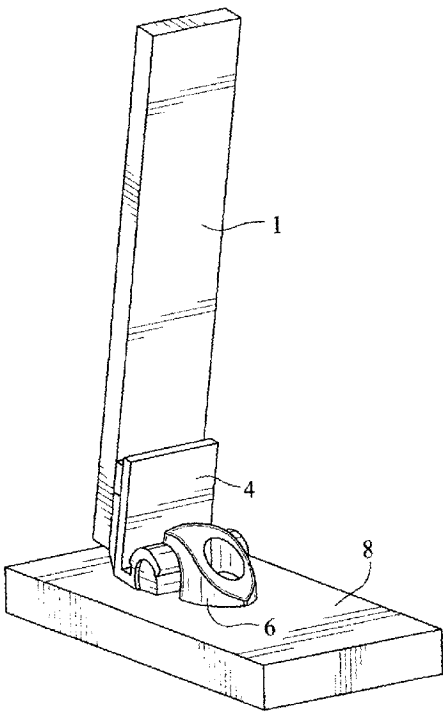
Figure 3:
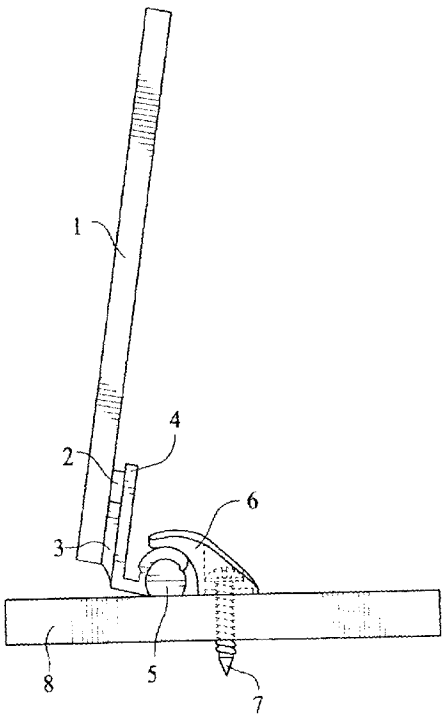

Although the gasket 5 is preferably cylindrical shaped, other shapes may be suitable to achieve its intended objective. In particular, with continued reference to FIGS. 1-4, the gasket 5 is shaped such that the bottom trim extrusion 4 is positionable in multiple orientations relative to a surface 8 and such that the gasket 5 maintains a sealing engagement in any of the bottom trim extrusion 4 multiple orientations. FIGS. 1 and 2 illustrate the curved sheet element 1 oriented at a shallow angle as may be found in a center sectional area of a boat windshield. FIGS. 3 and 4 show the curved sheet element 1 positioned in a more vertical orientation as may be found in side sections of a boat windshield or the like.

Also common to each embodiment is a securing member that is affixable to the surface 8 and cooperable with the bottom trim extrusion 4 and the gasket 5 to secure the bottom trim extrusion 4 to the surface 8 in any one of the bottom trim extrusion multiple orientations. In a first embodiment, the securing member comprises a mounting clip 6 affixable to the surface 8 with a connector 7 such as a screw or the like. The mounting clip 6 includes a connecting arm 6*a* engageable with the gasket receiving leg 4*b* in the channel 4*c* defined between the gasket receiving leg 4*b* and the connecting leg 4*a* of the bottom trim extrusion 4. As shown, the connecting arm 6*a* is preferably provided with a curved inside surface engageable with an outside surface of the gasket receiving leg 4*b*. In this manner, the connecting arm 6*a* fixes the bottom trim extrusion 4 in place in any of the bottom trim extrusion multiple orientations (e.g., compare the position of the connecting arm 6*a* on the gasket receiving leg 4*b* in FIGS. 1 and 3). With continued reference to the relative positions shown in FIGS. 1 and 3, the bottom trim extrusion 4 is positionable in multiple orientations relative to the securing member (e.g., mounting clip 6) without requiring detachment or repositioning of the securing member.

In assembling the bottom trim member shown in FIGS. 1-4, with the mounting clip 6 affixed to the surface 8 by the connector 7, the gasket 5 is compressed, and the gasket receiving leg 4*b* of the bottom trim extrusion 4 is fit under the connecting arm 6*a* of the mounting clip 6. The connecting arm 6*a* maintains the gasket 5 in the compressed state through a downward force on the gasket receiving leg 4*b*. The gasket 5 thus presses the gasket receiving leg 4*b* into engagement with the connecting arm 6*a*, thereby securing the parts together and securing the curved sheet element 1 to the surface 8.

Figure 6:
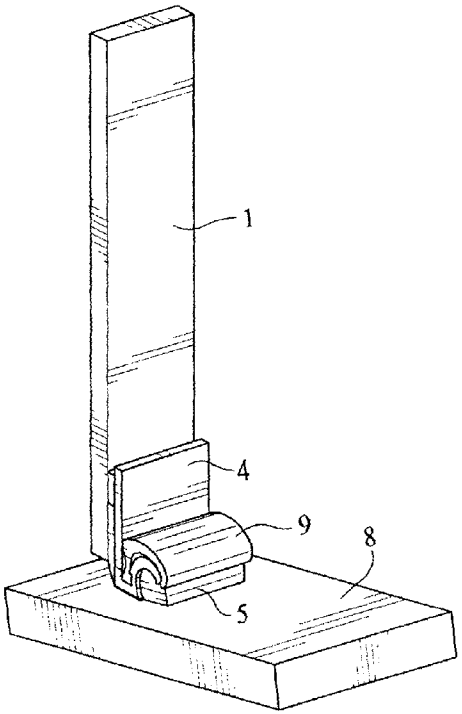
FIG. 6 is a rear perspective view of the bottom trim member in FIG. 5.
Figure 5:
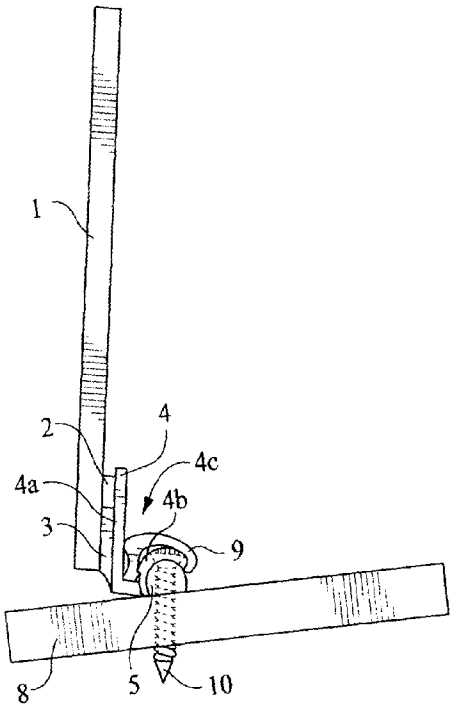
FIG. 5 is an end view of an alternative bottom trim member.

FIGS. 5 and 6 show an alternative embodiment for the securing member. In this embodiment, the securing member comprises a connector 10 such as a screw or the like extendible directly through the gasket receiving leg 4*b* and the gasket 5 into the surface 8. The gasket 5 is compressed between the boat surface and a head of the connector 10. The head of the connector 10 maintains the gasket 5 in the compressed state through a downward force on the gasket receiving leg 4*b*. A vinyl or rubber cover 9 may be fit over the connector 10 and secured in the channel 4*c* between the connecting leg 4*a* and the gasket receiving leg 4*b*. This embodiment is somewhat limited in the number of orientations of the bottom trim extrusion 4 relative to the surface 8. The embodiment is particularly suitable for areas with steep angles, such as those typical of the sides or wing sections of the boat windshield.

FIGS. 7-10 show an alternative construction, where the securing member comprises a lower extrusion 11 including a base leg 11*a* securable directly to the surface 8 via a connector 12 and a support leg 11*b* engageable with the gasket receiving leg 4*b* in the channel 4*c* defined between the gasket receiving leg 4*b* and the connecting leg 4*a* of the bottom trim extrusion 4. As shown, the base leg 11*a* and the support leg 11*b* define a receiving area therebetween, wherein the gasket receiving leg 4*b* and the gasket 5 are secured in the receiving area. Similar to the other embodiments, the support leg 11*b* maintains the gasket 5 in the compressed state through a downward force on the gasket receiving leg 4*b*.

Figure 8:
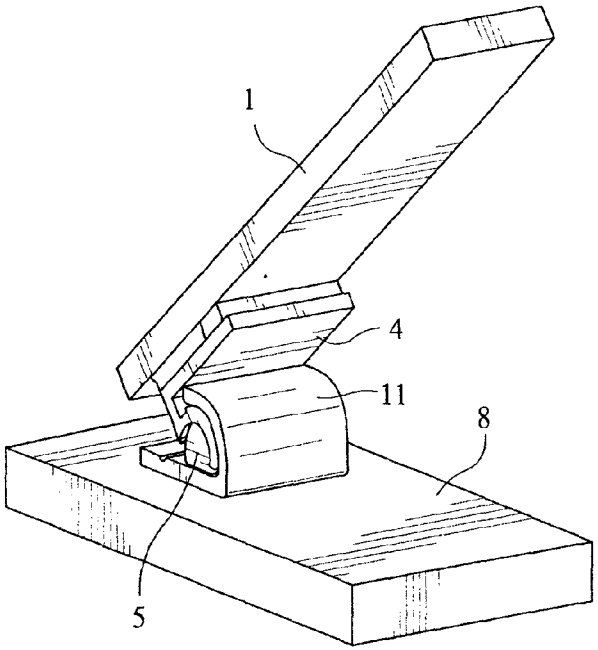
FIGS. 8 and 10 are rear perspective views of the bottom trim member in FIGS. 7 and 9.
Figure 7:
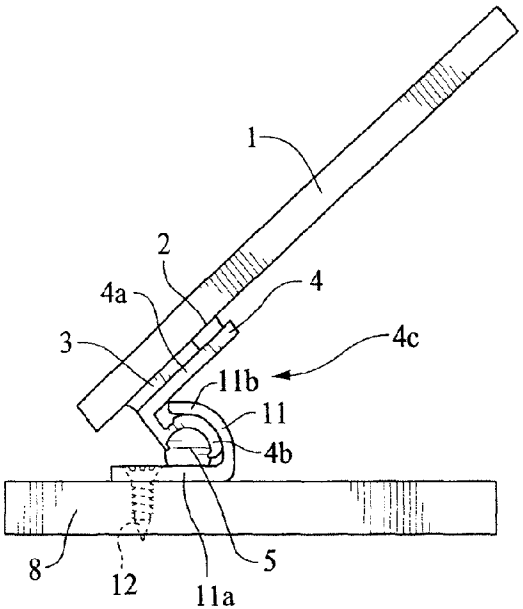
FIGS. 7 and 9 are end views of yet another bottom trim member.
Figure 10:
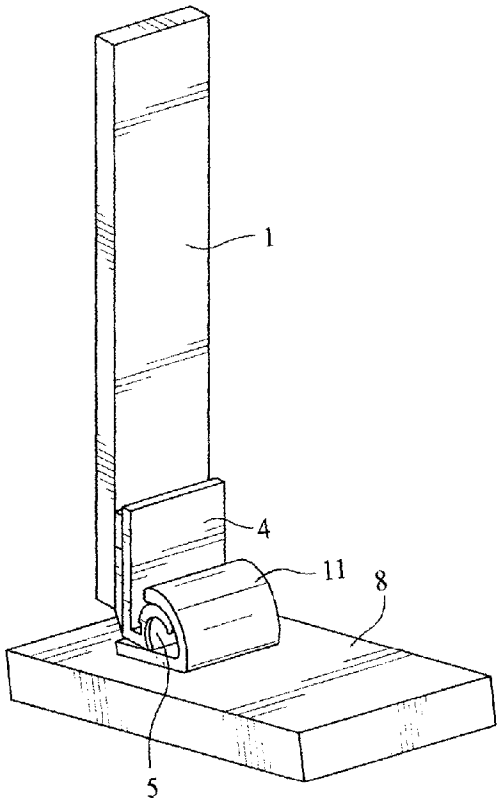
Figure 9:
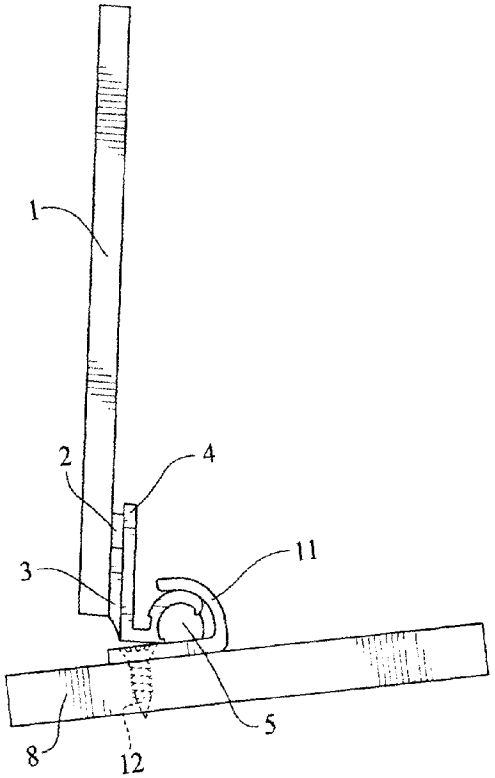

The shape of the support leg 11*b* generally corresponds to the shape of the gasket receiving leg 4*b*. As such, the bottom trim extrusion 4 is positionable relative to the surface 8 in the lower extrusion 11 between a narrow angled positioned as shown in FIGS. 7 and 8 and a steep angled position as shown in FIGS. 9 and 10.

In an exemplary application for securing a windshield 1 to a boat deck 8, in the embodiments shown in FIGS. 1-4 and FIGS. 7-10, the mounting clip 6 or the lower extrusion 11 is initially fixed to the boat deck 8. The windshield 1 is then placed on the deck 8 in front of the clip 6 or lower extrusion 11 and is pushed down to compress the gasket 5 while pushing it under the clip 6 or lower extrusion 11. The deflection of the elastic gasket 5 serves to retain the windshield in all directions except for the direction in which it was inserted. This can be retained as a last step by installing a screw through the trims along the inboard edge of the windshield by another at the back of the windshield. The windshield can be screwed down directly if using the construction illustrated in FIGS. 1-4 along the wings using the construction illustrated in FIGS. 5 and 6; or, if using the construction illustrated in FIGS. 7-10, by screwing directly through the lower extrusion 11 and the bottom trim extrusion 4. The gasket 5 is compressed and creates a seal to keep water out of the interior of the boat.

The described construction utilizes a bottom gasket and bottom trim extrusion to accommodate angle changes of a curved sheet element such as a windshield on a surface such as a boat deck. The simple construction is not bulky and reduces the number of parts as compared with the prior art constructions.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A bottom trim member for securing a windshield to a boat surface, the bottom trim member comprising:

a bottom trim extrusion including a first portion affixable to the windshield and a second portion that extends away from the windshield; and a securing member affixable to the boat surface with a connector and engageable with the second portion of the bottom trim extrusion such that the second portion of the bottom trim extrusion is interposed between the securing member and the boat surface to secure the bottom trim extrusion to the boat surface, wherein a space between the first portion of the bottom trim member and the second portion of the bottom trim member is sized such that both of the first portion and the second portion of the bottom trim extrusion is are positionable in multiple orientations relative to the securing member without requiring detachment or repositioning of the securing member, and wherein once positioned in one of the multiple orientations, the bottom trim extrusion is fixed relative to the securing member.

2. A bottom trim member according to claim 1, wherein the securing member is disposed in the space between the first portion of the bottom trim extrusion and the second portion of the bottom trim extrusion.

3. A bottom trim member according to claim 1, further comprising a gasket disposed between the second portion of the bottom trim extrusion and the boat surface.

4. A bottom trim member according to claim 1, wherein a portion of the securing member is curved into engagement with the second portion of the bottom trim member.

5. A bottom trim member according to claim 1, wherein a distal end of the securing member maintains the engagement with the second portion of the bottom trim extrusion regardless of a position of the windshield.

6. A bottom trim member according to claim 1, wherein the second portion of the bottom trim extrusion extends transversely away from the windshield.

7. A method of securing a curved sheet element on a surface comprising:

(a) affixing a first portion of a bottom trim extrusion to the curved sheet element, the bottom trim extrusion including a second portion that extends away from the curved sheet element;

(b) affixing a securing member to the surface;

(c) engaging the bottom trim extrusion with the securing member such that the second portion of the bottom trim extrusion is interposed between the securing member and the surface to secure the bottom trim extrusion to the surface; and (d) positioning both the first portion and the second portion of the bottom trim extrusion relative to the securing member to accommodate varying angles of the curved sheet element relative to the surface without detaching or repositioning the securing member.

8. A method according to claim 7, wherein step (b) is practiced before step (c).

9. A method according to claim 7, wherein the securing member comprises a mounting clip, and the mounting clip includes a connecting arm, and wherein step (b) is practiced by affixing the mounting clip to the surface with a connector, and engaging the connecting arm with the bottom trim extrusion in a channel defined between the first portion and the second portion of the bottom trim extrusion.

10. A method according to claim 7, further comprising positioning a gasket in engagement with the second portion of the bottom trim extrusion, the gasket being formed of an elastic material.

11. A method according to claim 10, wherein the gasket is cylindrical, the method further comprising providing the second portion of the bottom trim extrusion in a shape corresponding to an external surface of the gasket, and providing the securing member with a curved inside surface engaging an outside surface of the second portion.

12. A method according to claim 7, wherein the securing member includes a lower extrusion with a base leg and a support leg, and wherein step (b) is practiced by securing the base leg directly to the surface and engaging the support leg with the second portion of the bottom trim extrusion in a channel defined between the first portion and the second portion of the bottom trim extrusion.

13. A bottom trim assembly for securing a curved windshield to a boat surface where an angle between the curved windshield and the boat surface varies across the curved windshield, the bottom trim assembly comprising a multipart assembly including a first part secured to the curved windshield and a second part, separated from the first part, secured to the boat surface, wherein the second part is cooperable with the first part such that at least a portion of the first part is interposed between the second part and the boat surface to secure the first part and the curved windshield to the boat surface in a selectable orientation without requiring detachment or repositioning of the second part, wherein the first part comprises a first portion fixed to the windshield and a second portion extending transversely away from the windshield, and wherein both the first portion and the second portion are positionable in the selectable orientation relative to the second part.

14. A bottom trim assembly according to claim 13, wherein the second part is coupled with the second portion of the first part.

15. A bottom trim assembly according to claim 14, wherein the second part comprises an arm that extends over the second portion of the first part.

16. A bottom trim assembly according to claim 15, further comprising an elastic material disposed between the second portion of the first part and the boat surface.

17. A bottom trim assembly according to claim 13, wherein the second part comprises an arm that extends into a channel between the first portion and the second portion.

18. A bottom trim assembly according to claim 13, further comprising a gasket disposed between the first part and the boat surface.

19. A bottom trim assembly according to claim 13, further comprising a connector extending through the second part into the boat surface.

* * * * *